US005862496A

United States Patent [19]

Biven

[11] Patent Number: 5,862,496

[45] Date of Patent: Jan. 19, 1999

[54] METHOD OF COMPUTING DIVERT VELOCITY FOR THE GROUND-BASED INTERCEPTOR USING NUMERICAL PARTIAL DERIVATIVES

[75] Inventor: Earl U. Biven, Irvine, Calif.

[73] Assignee: McDonnell Douglas Corporation, Huntington Beach, Calif.

[21] Appl. No.: 723,102

[22] Filed: Oct. 1, 1996

[51] Int. Cl.[6] ..... G06F 165/00

[52] U.S. Cl. ..... 701/3; 244/3.11; 244/3.15

[58] Field of Search ..... 701/1, 3; 244/3.11, 244/3.15, 3.16, 3.21, 3.22; 342/62, 75, 106, 107

[56] References Cited

U.S. PATENT DOCUMENTS

| | | | |
|---|---|---|---|
| 3,795,911 | 3/1974 | Hammack | 342/106 |
| 4,760,397 | 7/1988 | Piccolruaz | 342/75 |
| 5,052,635 | 10/1991 | Paulet et al. | 244/3.11 |
| 5,071,087 | 12/1991 | Gray | 244/3.15 |
| 5,102,065 | 4/1992 | Couderc et al. | 244/3.16 |
| 5,435,503 | 7/1995 | Johnson, Jr. et al. | 701/3 |
| 5,464,174 | 11/1995 | Laures | 244/3.16 |
| 5,669,581 | 9/1997 | Ringer | 244/3.16 |
| 5,671,138 | 9/1997 | Bessacini et al. | 701/1 |

*Primary Examiner*—Gary Chin
*Attorney, Agent, or Firm*—Harness Dickey & Pierce P.L.C.

[57] ABSTRACT

A ground-based interceptor missile, part of a larger ballistic missile defense system, is provided for intercepting enemy intercontinental ballistic missiles. The interceptor employs a method based on numerical partial derivatives for computing required divert velocity corrections to remove predicted ground-based interceptor miss errors for engagement during the midcourse of the enemy missile flight.

5 Claims, 3 Drawing Sheets

FIG 2
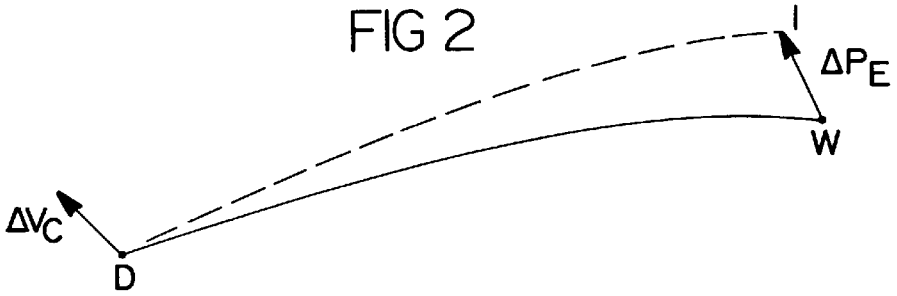
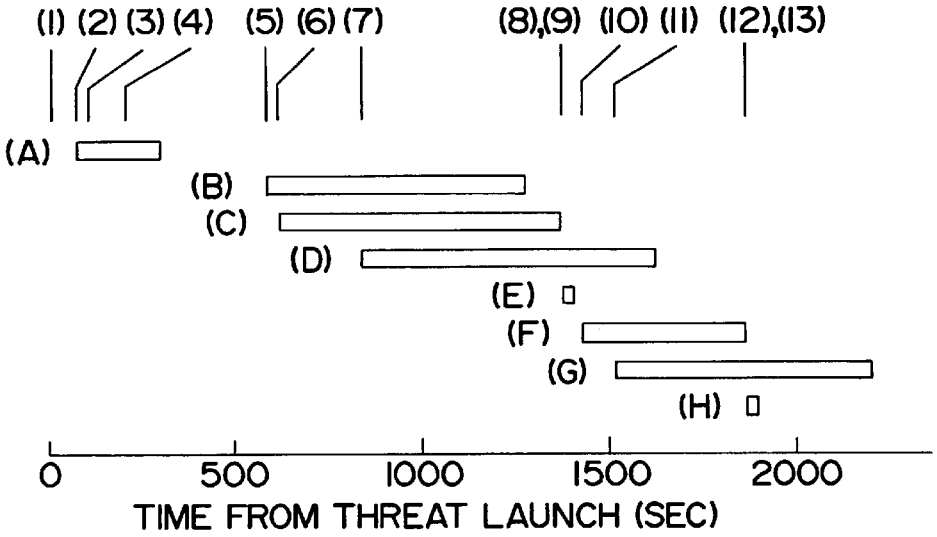
FIG 3
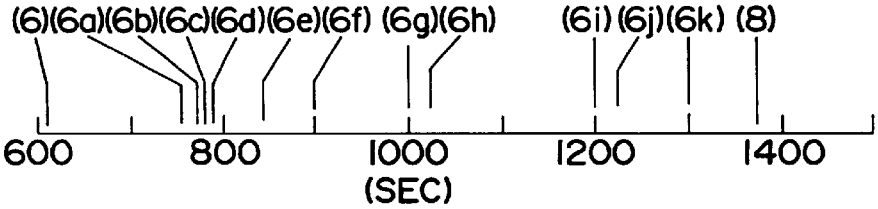
FIG 4

METHOD OF COMPUTING DIVERT VELOCITY FOR THE GROUND-BASED INTERCEPTOR USING NUMERICAL PARTIAL DERIVATIVES

BACKGROUND OF THE INVENTION

1. Field of the Invention

The present invention relates to a ballistic missile defense system to protect against intercontinental ballistic missile attacks, the ground-based interceptor missile part of that defense system to intercept enemy missile warheads, and more particularly, a method for computing required divert velocity corrections to remove predicted ground-based interceptor miss errors for engagements during the midcourse of the enemy missile flight.

BACKGROUND AND SUMMARY OF THE INVENTION

The ground-based interceptor missile is designed to intercept enemy intercontinental ballistic missile warheads in the mid-course of flight to targeted aim points. The ground-based interceptor missile system is composed of a booster, a kill vehicle, and the ground equipment required to launch the missile.

The part of the ground-based interceptor missile remaining after the boost phase, the kill vehicle, is the part that intercepts the enemy warhead. Typically, an initial ground-based interceptor missile is launched to intercept the threat missile as early as possible so that, in case of a miss, one or more additional interceptors could be launched to successfully intercept the lethal warhead. The initial intercepts will typically be at long ranges from the ground-based interceptor launch site. In order to remove predicted position error at intercept, a divert velocity correction must be computed and the consequent kill vehicle thrust corrections applied to remove the error. The present invention provides a new method to compute the ground-based interceptor divert velocity required for removing predicted position error at intercept.

The problem is to compute the ground-based interceptor mid-course divert velocity needed to remove a predicted error at intercept. The geometry is illustrated in FIG. 2. At time $t_D$, the ground-based interceptor vehicle is at point D on an exoatmospheric ballistic trajectory to the wrong intercept point W at intercept time $t_I$. The system has updated the predicted intercept point to point I based on new data provided by the tracking radars. The difference between points I and W is the position error vector $\Delta P_E$ that must be removed to put the ground-based interceptor back on a collision course. Over a "flat earth" or if the time between $t_D$ and $t_I$ is short, the correction divert velocity vector $\Delta V_C$ at time $t_D$ is given simply by $\Delta V_C=\Delta P_E/(t_I-t_D)$ assuming an instantaneous accumulation of divert velocity. However, the earth is not flat, and over a long time (or large earth central angle) this equation is in gross error in both magnitude and direction for $\Delta V_C$. The divert computation of the present invention avoids this gross error by taking into account the oblateness of the earth automatically. Accordingly, it is desirable in the art of missile defense systems to provide a method for computing the ground-based interceptor divert velocity which is simple in concept, valid for trajectories over complicated earth models, extremely accurate, and which minimizes the ground-based interceptor kill vehicle fuel required for mid-course diverts. Accordingly, the present invention provides a method of calculating a divert velocity to remove a predicted error at intercept which accomplishes each of these objectives.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 2 illustrates the ground-based interceptor trajectory and divert geometry for correcting the trajectory of the ground-based interceptor;

FIG. 3 is a ballistic missile defense timeline illustrating the time from the launch of a threat missile to its successful intercept;

FIG. 4 illustrates an example timeline of typical ground-based interceptor engagement events which occur after launch of a ground-based interceptor missile.

DETAILED DESCRIPTION OF THE PREFERRED EMBODIMENTS

Figure 1:
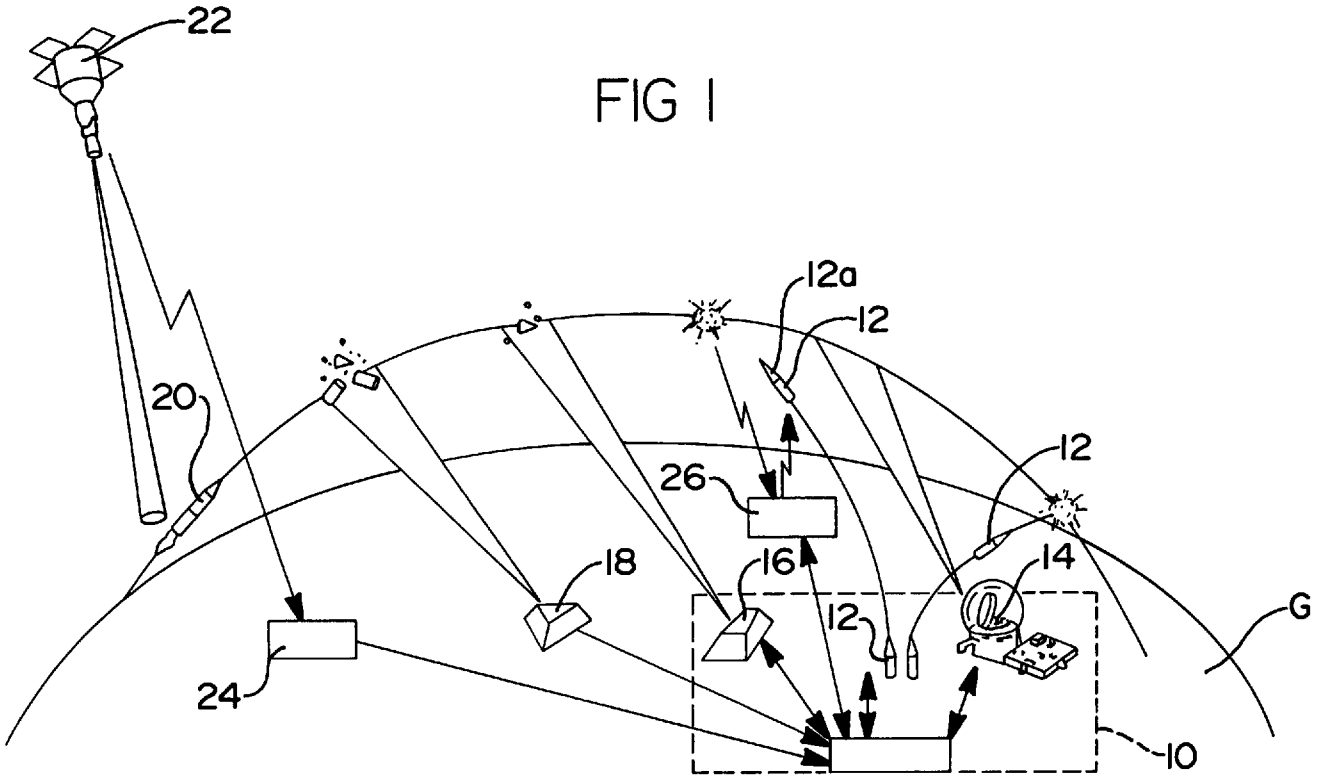
FIG. 1 is a general diagrammatic view illustrating the implementation of the ballistic missile defense system in accordance with the present invention.
Figure 5:
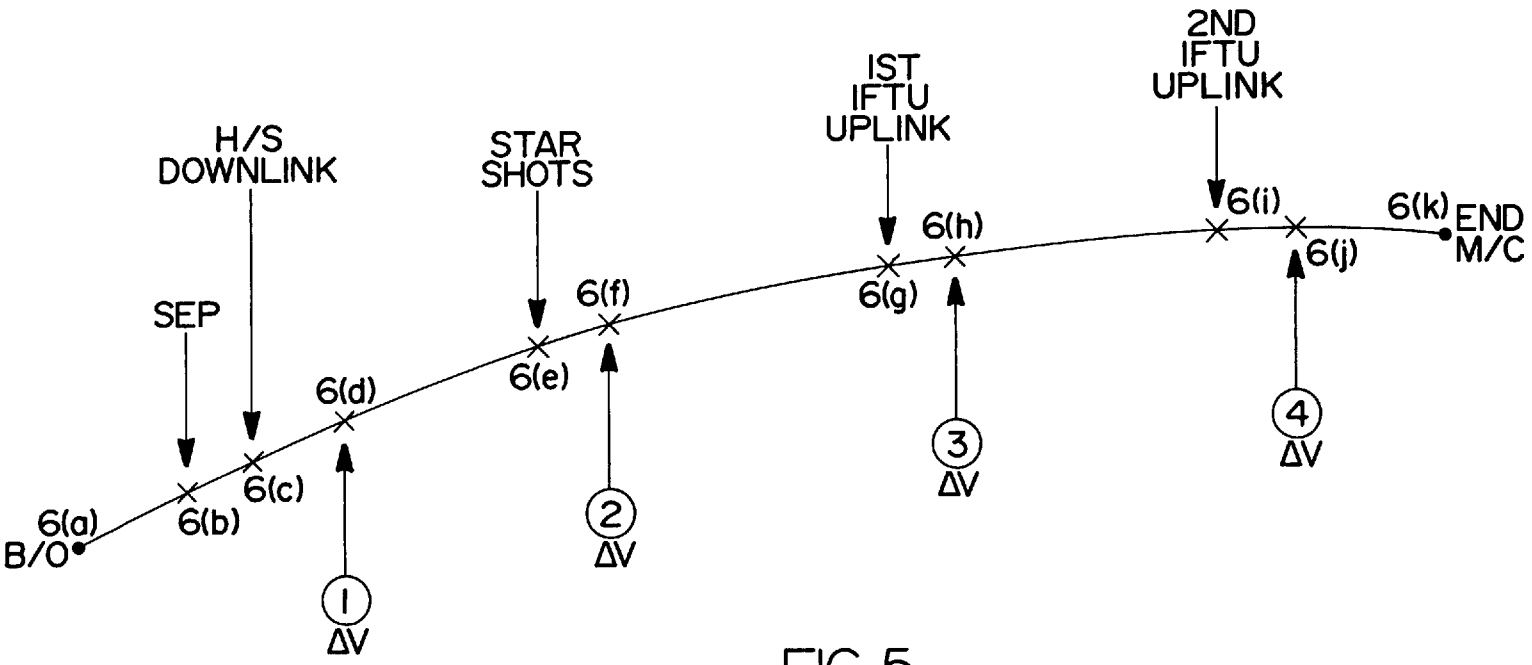
FIG. 5 illustrates the engagement events during the mid-course phase of the ground-based interceptor missile flight.

The ballistic missile defense system according to the present invention is illustrated diagrammatically by FIG. 1. The ballistic missile defense system includes a ground element 10 set on the ground G, and includes a set of ground-based interceptor missiles 12. Ground element 10 includes a site radar 14 which, along with remote radar stations 16, 18. An orbiting satellite 22 is provided for initially detecting the launch of the enemy missile 20 and notifying the ground element 10 via ground entry point antenna 24. Radars 14, 16, and 18 identify and track an incoming enemy missile 20. Additional ground entry point antennas 26 are provided for transmitting update information from the ground element 10 to an in-flight ground-based interceptor missile 12.

FIG. 3 illustrates an example timeline for the events which occur in a typical ballistic missile defense engagement. For example, at the time (1) of zero seconds a threat enemy intercontinental ballistic missile is launched. At time (2) of 60 seconds satellite 22 detects the burning missile booster. At time (3) of 100 seconds satellite 22 sends a warning to the ground element 10 via ground entry point antenna 24. At time (4) of 200 seconds the ground element 10 cues the early warning radars 16, 18 to begin surveillance. At time (5) of 577 seconds the early warning radar 18 starts collecting data on the position and velocity of the incoming enemy missile 20 and calculates an estimated trajectory for the incoming missile 20. The ground element 10 then calculates an intercept trajectory for a ground-based interceptor missile 12. At time (6) of 607 seconds, a first ground-based interceptor missile 12 is launched in order to intercept the incoming missile 20 at a predicted intercept point.

With reference to FIG. 4, the ground-based interceptor typical mid-course engagement events are described in detail. At time 6(*a*) of 750 seconds, the ground-based interceptor booster burns out to start the interceptor mid-course phase. At time 6(*b*) of 780 seconds, the kill vehicle 12*a* separates from the third stage booster. At time 6(*c*) of 782 seconds the kill vehicle health and status is downlinked to the ground element 10. At time 6(*d*) of 790 seconds, the on-board computer computes the required divert correction and the first divert correction is applied to remove interceptor error imparted during boost. At time (6*e*) of 840 seconds, star shots (i.e. sightings) are made to improve the inertial measuring unit alignment of the kill vehicle 12*a*. At step 6(*f*) of 900 seconds a second divert correction is computed and carried out to remove errors induced by the star shots. At time 6(*g*) of 1000 seconds, the ground element 10 uplinks a first in-flight target update of the predicted intercept point. The on-board computer of the ground-based interceptor kill vehicle 12*a* calculates a ground based interceptor divert velocity which is made at time 6(*h*) of 1020 seconds toward the updated predicted intercept point then applies the necessary divert thrust to correct the trajectory of the kill vehicle 12*a*. If available, at time 6(*i*) of 1200 seconds, the ground element 10 provides a second in-flight target update of a further improved predicted intercept point. At time 6(*j*) of approximately 1220 seconds a mid-course divert correction is made by the on-board computer and the necessary correction is made to direct the kill vehicle 12*a* toward the second improved predicted intercept point. During the interceptor (kill vehicle) midcourse phase of flight, the on-board computer will use the method of this invention to calculate each required divert correction to remove each new error as determined by the vector difference between the latest estimate of the predicted intercept point and the interceptor position integrated to intercept time. At time 6(*k*), the kill vehicle starts on-board detection of the threat objects complex containing enemy missile 20, which ends the mid-course phase of the ground based interceptor missile trajectory. The kill vehicle then utilizes its own on-board homing system to intercept the enemy missile at time (8) of 1372 seconds. At that time (9), ground element 10 commences a kill assessment for the first ground based interceptor missile 12. If the incoming missile 20 was not properly intercepted, a second ground-based interceptor missile is launched at time (10) of 1422 seconds. The second ground-based interceptor missile is guided according to the same steps as discussed with reference to FIG. 4. At time (12) of 1871 seconds, the second ground-based interceptor missile intercepts the incoming missile 20. At that time (13), a kill assessment is commenced by ground element 10.

The method for computing the divert velocity for the ground based interceptor missile 12 utilizing numerical partial derivatives, is described below. Using an accurate trajectory numerical integration routine, the divert velocity is calculated according to the following steps.

(1) Determining a state vector at divert time for the ground-based interceptor in earth-centered inertial (E.C.I.) coordinates:

$t_D$, $X_D$, $Y_D$, $Z_D$, $V_{XD}$, $V_{YD}$, $V_{ZD}$;

(2) Generating three more state vectors by adding 1 mps to the nominal velocity, separately, along each velocity direction:

$t_D$, $X_D$, $Y_D$, $Z_D$, $(V_{XD}+1)$, $V_{YD}$, $V_{ZD}$ (for $\Delta V_X$=1 mps)

$t_D$, $X_D$, $Y_D$, $Z_D$, $V_{XD}$, $(V_{YD}+1)$, $V_{ZD}$ (for $\Delta V_Y$=1 mps)

$t_D$, $X_D$, $Y_D$, $Z_D$, $V_{XD}$, $V_{YD}$, $(V_{ZD}+1)$ (for $\Delta V_Z$=1 mps)

(3) Numerically integrating all four trajectories to intercept time $t_I$ to give position vectors:

$P_I=X_{IO}+Y_I j_O+Z_I k_O$ (for reference traj)

$P_{IX}=X_{IX} i_O+Y_{IX} j_O+Z_{IX} k_O$ (for $\Delta V_X$ traj)

$P_{IY}=X_{IY} i_O+Y_{IY} j_O+Z_{IY} K_O$ (for $\Delta V_Y$ traj)

$P_{IZ}=X_{IZ} i_O+Y_{IZ} j_O+Z_{IZ} k_O$ (for $\Delta V_Z$ traj)

where $i_O$, $j_O$, $k_O$ are unit vectors in earth-centered inertial coordinates and the X's, Y's and Z's are the components along the earth centered inertial axes;

(4) Difference the components to get the (m/mps) coefficients:

$B_{11}=\delta X_I/\delta V_{XD}=X_{IX}-X_I$ (m/mps)

$B_{12}=\delta X_I/\delta V_{TD}=X_{IY}-X_I$ $B_{13}=\delta X_I/\delta V_{ZD}=X_{IZ}-X_I$ $B_{21}=\delta Y_I/\delta V_{XD}=Y_{IX}-Y_I$ $B_{22}=\delta Y_I/\delta V_{YD}=Y_{IY}-Y_I$ $B_{23}=\delta Y_I/\delta V_{ZD}=Y_{IZ}-Y_I$ $B_{31}=\delta Z_I/\delta V_{XD}=Z_{IX}-Z_I$ $B_{32}=\delta Z_I/\delta V_{YD}=Z_{IY}-Z_I$ $B_{33}=\delta Z_I/\delta V_{ZD}=Z_{IZ}-Z_I$ Note that there are nine coefficients here. Each represents the numerical partial derivative of intercept position with respect to divert velocity, i.e., the differential change in intercept position along a particular ECI coordinate axis due to a differential change (1 mps) in velocity at divert time along a particular ECI axis. The 1 mps is merely a convenient small number that makes the subtraction on the right sides of the equations above invisible to the implicit divisions by value 1 (mps).

(5) The relative position at intercept in terms of the divert velocity is:

$$\begin{pmatrix} \Delta X_I \\ \Delta Y_I \\ \Delta Z_I \end{pmatrix} = \begin{bmatrix} B_{11} & B_{12} & B_{13} \\ B_{21} & B_{22} & B_{23} \\ B_{31} & B_{32} & B_{33} \end{bmatrix} \begin{pmatrix} \Delta V_{XD} \\ \Delta V_{YD} \\ \Delta V_{ZD} \end{pmatrix}$$

or $$\Delta P_I = B\,\Delta V_D$$

(6) The inverse relation gives the divert velocity vector at time $t_D$ that corrects a position error at intercept time $t_I$:

$$\Delta V_D=B^{-1}\Delta P_I;\text{ and}$$

A divert thrust is then applied by the kill vehicle in order to obtain a divert velocity equal to $\Delta V_D$.

(7) If the computed divert velocity is large, a second computation cycle or iteration can be carried out to improve the accuracy of the divert velocity.

Simulation runs using the ground-based interceptor divert velocity calculation method according to the present invention show that this method can reduce a 10,000 meter error at intercept to less than two meters in one calculation pass and divert sequence for a 1300 second coast between divert and intercept time. The method of the present invention is uniquely suited to ground-based interceptor missiles where coast times between divert and intercept can be several hundred seconds long.

Although this method of computing divert velocity is most suitable for solving the ground-based interceptor divert calculation when the coast time between divert and intercept is hundreds of seconds long, the method can be adapted to any exoatmospheric divert calculation. In concept, the use of numerical partial derivatives can also be applied to endoatmospheric divert calculations whereby the partials are different, e.g. the differential changes in intercept position with respect to differential changes in fin angles, where care must be taken to be consistent between application of the fin angle and intercept.

The divert calculation process of the present invention is simple in concept, and generates extremely accurate required divert velocity components on a single calculation pass without iterating for improvements. The numerical partial derivatives are used to relate the predicted position error components at intercept to the required divert velocity components required to remove those errors. The method can use any accurate numerical integration routine and any oblate earth model to generate intercept positions from state vectors at divert time.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for generating on-board guidance divert commands for an intercept vehicle based on numerical partial derivatives using a numerical trajectory integration algorithm, the method comprising the steps of:

obtaining a predicted intercept position vector (PIP) and intercept time ($t_I$) of an enemy strategic ballistic missile;

generating an inverse coefficient matrix for converting a position error vector at said intercept time ($t_I$) to a required divert velocity vector at a divert time ($t_D$) by the following steps:

obtaining from an on-board navigation system on said intercept vehicle a state vector for the intercept vehicle at divert time ($t_D$) in a set of inertial coordinates as $t_D$, $X_D$, $Y_D$, $Z_D$, $V_{XD}$, $V_{YD}$, $V_{ZD}$ where $X_D$, $Y_D$, $Z_D$ are position components and $V_{XD}$, $V_{YD}$, $V_{ZD}$ are velocity components at said divert time ($t_D$);

generating three more state vectors by adding 1 meter-per-second (mps) to each component of the reference velocity, separately, as $t_D$, $X_D$, $Y_D$, $Z_D(V_{XD}+1)$, $V_{YD}$, $V_{ZD}$ (for $\Delta V_X$=1 mps)

$t_D$, $X_D$, $Y_D$, $Z_D$, $V_{XD}$, $(V_{YD}+1)$, $V_{ZD}$ (for $\Delta V_Y$=1 mps)

$t_D$, $X_D$, $Y_D$, $Z_D$, $V_{XD}$, $V_{YD}$, $(V_{ZD}+1)$ (for $\Delta V_Z$=1 mps)

numerically integrating all of said four state vectors to intercept time ($t_I$) to provide four position vectors:

$P_I=X_I i_O+Y_I j_O+Z_I K_O$ (for a reference trajectory)

$P_{IX}=X_{IX} i_O+Y_{IX} j_O+Z_{IX} K_O$ (for $\Delta V_X$ traj)

$P_{IY}=X_{IY} i_O+Y_{IY} j_O+Z_{IY} K_O$ (for $\Delta V_Y$ traj)

$P_{IZ}=X_{IZ} i_O+Y_{IZ} j_O+Z_{IZ} K_O$ (for $\Delta V_Z$ traj)

where $i_O$, $j_O$, $k_O$, are unit vectors in said inertial coordinates and each of said X, Y and Z values represents a position component along said inertial coordinates;

calculating a delta change in position at said intercept time ($t_I$) along a particular inertial coordinate axis due to a delta change in velocity at said divert time ($t_D$) along a particular inertial axis to obtain coefficients:

$B_{11}=\delta X_I/\delta V_{XD}=X_{IX}-X_I$ (m/mps)

$B_{12}=\delta X_I/\delta V_{YD}=X_{IY}-X_I$ $B_{13}=\delta X_I/\delta V_{ZD}=X_{IZ}-X_I$ $B_{21}=\delta Y_I/\delta V_{XD}=Y_{IX}-Y_I$ $B_{22}=\delta Y_I/\delta V_{YD}=Y_{IY}-Y_I$ $B_{23}=\delta Y_I/\delta V_{ZD}=Y_{IZ}-Y_I$ $B_{31}=\delta Z_I/\delta V_{XD}=Z_{IX}-Z_I$ $B_{32}=\delta Z_I/\delta V_{YD}=Z_{IY}-Z_I$ $B_{33}=\delta Z_I/\delta V_{ZD}=Z_{IZ}-Z_I$ wherein coefficients $B_{11}$–$B_{33}$ are nine numerically-calculated coefficients of a coefficient matrix that relate said one meter-per-second delta velocities at said divert time ($t_D$) to resultant delta positions at said intercept time ($t_I$) as represented in a matrix equation:

$$\begin{pmatrix} \Delta X_1 \\ \Delta Y_1 \\ \Delta Z_1 \end{pmatrix} = \begin{bmatrix} B_{11} & B_{12} & B_{13} \\ B_{21} & B_{22} & B_{23} \\ B_{31} & B_{32} & B_{33} \end{bmatrix} - \begin{pmatrix} \Delta V_{XD} \\ \Delta V_{YD} \\ \Delta V_{ZD} \end{pmatrix}$$

and as also represented in vector equation form, $\Delta P_I=\Delta V_D$ wherein $\Delta P_I$ is the resultant delta position vector at said intercept time ($t_I$) due to divert velocity vector $\Delta V_D$ consisting of unity components executed at said divert time ($t_D$);

computing the inverse of said coefficient matrix to give;

subtracting the reference interceptor position vector $P_I$ from said predicted intercept position vector (PIP) to give a position error $\Delta P_E$ at said intercept time;

$\Delta P_E=PIP-P_I$; and calculating the required correction velocity $\Delta V_C$ as one of said guidance divert commands for said intercept vehicle at said divert time ($t_D$) to correct the position error $\Delta P_E$ at said intercept time ($t_I$): $\Delta V_C=\Delta P_E$.

2. An interceptor missile guidance system comprising;

a system for interfacing with an on-board radar antenna/receiver of an interceptor missile for receiving an updated intercept time ($t_I$) and predicted intercept point (PIP) computed by a ground based control station and transmitted from a ground based transmitter directly or relayed via orbiting satellites;

an on-board sensor system;

a system for interfacing with the on-board sensor system after an enemy warhead has been tracked by said on-board sensor system;

a high speed data processor and memory connected to said system for interfacing with said on-board sensor system including:

a processor apparatus for carrying out calculations resulting in divert velocity commands;

a memory for storing data and first and second software algorithms;

said first algorithm for integrating calculated ballistic missile state vectors including a reference state vector at a divert time and three state vectors obtained at said divert time by adding one meter-per-second to each velocity vector component of each one of X, Y and Z axes of said reference state vector; and second algorithm for using integrated position vectors at said intercept time to generate a coefficient matrix and its inverse, wherein said inverse coefficient matrix relates a resultant delta position vector at said intercept time to a delta velocity vector that caused it at said divert time, and determining therefrom a guidance divert velocity command needed to be applied to said interceptor missile to intercept said enemy ballistic missile warhead at said intercept time.

3. A method for generating on-board guidance divert commands for an intercept vehicle based on numerical partial derivatives and using a numerical trajectory integration algorithm, the method comprising the steps:

obtaining a predicted intercept position vector (PIP) and intercept time ($t_I$) for intercepting an enemy ballistic missile warhead;

generating an inverse coefficient matrix for converting a position error vector at said intercept time ($t_I$) to a required divert velocity vector at divert time ($t_D$) by the following steps:

obtaining from an on-board navigation system on said intercept vehicle a first reference state vector for the intercept at said divert time ($t_D$) in a set of inertial coordinates consisting of independent X, Y and Z axes, each mutually perpendicular to the others;

generating second, third, and fourth state vectors representing delta velocity trajectories by adding 1 meter-per-second (mps) to each velocity component of said first reference state vector along said independent X, Y and Z axes;

numerically integrating each of said state vectors to intercept time ($t_I$) to provide four position vectors including a reference position vector PI and second, third, and fourth position vectors PIX, PIY and PIZ;

calculating a change in position with respect to said first reference position vector PI at said intercept time ($t_I$) along each particular inertial coordinate axis due to a small change in velocity of said first reference state vector at said divert time ($t_D$) along each said inertial axis to obtain a plurality of numerically-calculated coefficients for a coefficient matrix that relates the delta velocities created by adding one meter-per-second to each velocity component along said X, Y, and Z axes at said divert time ($t_D$) to resultant delta positions at said intercept time ($t_I$);

inverting said coefficient matrix to obtain an inverse coefficient matrix that relates any resultant delta position vector ($\Delta P_I$) at said intercept time ($t_I$) to the delta velocity vector ($\Delta V_D$) that caused it at said divert time ($t_D$);

subtracting said first reference position vector PI from said predicted intercept position vector (PIP) to give a position error vector ($\Delta P_E$) at said intercept time ($t_I$) that must be removed to effect intercept of said enemy ballistic missile warhead; and using said inverse coefficient matrix to calculate the required delta correction velocity ($\Delta V_C$) at said divert time ($t_D$) to correct said position error ($\Delta P_E$) at said intercept time ($t_I$), wherein said delta correction velocity ($\Delta V_C$) is the guidance divert command needed by said intercept vehicle at said divert time ($t_D$) to intercept said enemy ballistic missile warhead at said intercept time ($t_I$).

4. A method for generating on-board guidance divert commands for an intercept vehicle based on numerical partial derivatives and using a numerical trajectory integration algorithm, the method comprising the steps of:

obtaining a predicted intercept position vector (PIP) and intercept time ($t_I$) for intercepting an enemy ballistic missile warhead;

generating an inverse coefficient matrix for converting a position error vector at said intercept time ($t_I$) to a required divert velocity vector at divert time ($t_D$) by the following steps:

obtaining from an on-board navigation system of said intercept vehicle a first reference state vector for the intercept at a divert time ($t_D$) in a set of inertial coordinates consisting of independent X, Y and Z axes;

generating second, third and fourth state vectors at divert time ($t_D$) representing delta velocity trajectories by adding one meter-per-second to each velocity component of said first reference state vector along independent X, Y and Z axes thereof;

integrating each state vector to intercept time ($t_I$) to produce four position vectors;

using said four position vectors to obtain a coefficient matrix that relates the delta velocities at said divert time ($t_D$) to resultant delta positions at said intercept time ($t_I$);

inverting said coefficient matrix to obtain a resultant delta position vector at said intercept time ($t_I$) due to a delta velocity vector that caused it at said divert time ($t_D$);

using said reference position vector and said predicted intercept position vector (PIP) to determine a position error vector at said intercept time ($t_I$) that must be removed to effect intercept of said enemy ballistic missile warhead; and using said inverted coefficient matrix to obtain a delta correction velocity which represents the guidance divert command required by said intercept vehicle at said divert time ($t_D$) to intercept said enemy ballistic missile warhead at said intercept time.

5. A method for generating guidance commands for an intercept vehicle based on numerical partial derivatives and using a numerical trajectory integration algorithm and included appropriate data tables and vehicle characteristics needed by said numeral trajectory integration algorithm to completely describe the dynamics motion of said intercept vehicle, the method comprising the steps of:

obtaining a predicted intercept position vector (PIP) and intercept time ($t_I$) for intercepting target vehicle;

obtaining from an on-board control system a reference set of parameters that describe an initial condition of said intercept vehicle including the position, velocity, body attitude, and attitude rate at a command implementation time;

generating at least two more sets of independent control parameters representing initial conditions for delta trajectories by incrementing each of said two independent control parameters by a small amount, said independent control parameters being part of said reference set of parameters that describe the initial condition of said intercept vehicle;

numerically integrating each said delta trajectory starting at said initial conditions and using said numerical trajectory integration algorithm and said appropriate data tables and vehicle characteristics to intercept time ($t_I$) to provide a reference trajectory position vector (PI) and position vectors for said delta trajectories at said intercept time ($t_I$);

calculating the difference in position at said intercept time ($t_I$) of each delta trajectory with respect to said reference trajectory position vector (PI) at said intercept time ($t_I$), wherein each said difference in position has three independent components;

computing a coefficient matrix that relates said differences in position components to said delta amounts of said independent control parameters;

computing an inverse coefficient matrix of said coefficient matrix, or pseudoinverse coefficient matrix in cases where the coefficient matrix is not square, to obtain a reverse transformation matrix that relates, to first order, any resultant delta position vector at said intercept time ($t_I$) to delta amounts of said independent control parameters at said command implementation time;

subtracting said reference trajectory position vector ($P_I$) from said predicted intercept position vector (PIP) to give a position error vector ($\Delta P_E$) at said intercept time ($t_I$) that must be removed to effect intercept of said target vehicle;

using said reverse transformation matrix to calculate required delta correction amounts of each said independent control parameter at said command implementation time to correct said position error ($\Delta P_E$) at said intercept time ($t_I$), wherein said required delta correction amounts of each said independent control parameter comprise the guidance commands needed by said intercept vehicle at said command implementation time to intercept said target vehicle at said intercept time ($t_I$).

* * * * *

UNITED STATES PATENT AND TRADEMARK OFFICE

CERTIFICATE OF CORRECTION

PATENT NO. : 5,862,496

DATED : January 19, 1999

INVENTOR(S) : Earl U. Biven

It is certified that error appears in the above-identified patent and that said Letters Patent is hereby corrected as shown below:

Column 3, Line 65, "intercept" should be --underscored--.

Column 4, Line 11, "$_{TD}$" should be --$_{YD}$--.

Column 5, Line 46, Claim 1, the last element in each equation should be represented by a lower case "k" as follows:

"$P_I = X_I\, i_O + Y_I\, j_0 + Z_I\, K_0$ (for a reference trajectory)
$P_{IX} = X_{IX}\, i_0 + Y_{IX}\, j_0 + Z_{IX}\, K_0$ (for $\Delta V_X$ traj)
$P_{IY} = X_{IY}\, i_0 + Y_{IY}\, j_0 + Z_{IY}\, K_0$ (for $\Delta V_Y$ traj)
$P_{IZ} = X_{IZ}\, i_0 + Y_{IZ}\, j_0 + Z_{IZ}\, K_0$ (for $\Delta V_Z$ traj)

should be

"$P_I = X_I\, i_O + Y_I\, j_0 + Z_I\, k_0$ (for a reference trajectory)
$P_{IX} = X_{IX}\, i_0 + Y_{IX}\, j_0 + Z_{IX}\, k_0$ (for $\Delta V_X$ traj)
$P_{IY} = X_{IY}\, i_0 + Y_{IY}\, j_0 + Z_{IY}\, k_0$ (for $\Delta V_Y$ traj)
$P_{IZ} = X_{IZ}\, i_0 + Y_{IZ}\, j_0 + Z_{IZ}\, k_0$ (for $\Delta V_Z$ traj)

Column 5, Line 58, Claim 1

"$B_{11} = \delta X_I/\delta V_{XD} = X_{IX} - X_I$ (m/mps)
$B_{12} = \delta X_I/\delta V_{YD} = X_{IY} - X_I$
$B_{13} = \delta X_I/\delta V_{ZD} = X_{IZ} - X_I$
$B_{21} = \delta Y_I/\delta V_{XD} = Y_{IX} - Y_I$
$B_{22} = \delta Y_I/\delta V_{YD} = Y_{IY} - Y_I$
$B_{23} = \delta Y_I/\delta V_{ZD} = Y_{IZ} - Y_I$
$B_{31} = \delta Z_I/\delta V_{XD} = Z_{IX} - Z_I$
$B_{32} = \delta Z_I/\delta V_{YD} = Z_{IY} - Z_I$
$B_{33} = \delta Z_I/\delta V_{ZD} = Z_{IZ} - Z_I$"

UNITED STATES PATENT AND TRADEMARK OFFICE

CERTIFICATE OF CORRECTION

PATENT NO. : 5,862,496

DATED : January 19, 1999

INVENTOR(S) : Earl U. Biven

It is certified that error appears in the above-identified patent and that said Letters Patent is hereby corrected as shown below:

should be:

$B_{11} = \Delta X_I/\Delta V_{XD} = X_{IX} - X_I$ (m/mps)
$B_{12} = \Delta X_I/\Delta V_{YD} = X_{IY} - X_I$
$B_{13} = \Delta X_I/\Delta V_{ZD} = X_{IZ} - X_I$
$B_{21} = \Delta Y_I/\Delta V_{XD} = Y_{IX} - Y_I$
$B_{22} = \Delta Y_I/\Delta V_{YD} = Y_{IY} - Y_I$
$B_{23} = \Delta Y_I/\Delta V_{ZD} = Y_{IZ} - Y_I$
$B_{31} = \Delta Z_I/\Delta V_{XD} = Z_{IX} - Z_I$
$B_{32} = \Delta Z_I/\Delta V_{YD} = Z_{IY} - Z_I$
$B_{33} = \Delta Z_I/\Delta V_{ZD} = Z_{IZ} - Z_I$"

UNITED STATES PATENT AND TRADEMARK OFFICE

CERTIFICATE OF CORRECTION

PATENT NO. : 5,862,496

DATED : January 19, 1999

INVENTOR(S) : Earl U. Biven

It is certified that error appears in the above-identified patent and that said Letters Patent is hereby corrected as shown below:

Column 6, line 2, Claim 1, after "matrix", insert -- [B].

Column 6, line 6, Claim 1, delete "-" in equation.

Column 6, line 12, Claim 1, after $\Delta P_i$= insert [B].

Column 6, line 18, Claim 1, after "matrix" insert [B].

Column 6, line 18, Claim 1, after "give" insert [B].

Column 6, line 26, Claim 1, after $\Delta V_c$= insert $[B]^{-1}$.

Column 6, line 51, insert -- said -- before "second".

Signed and Sealed this

Twenty-second Day of June, 1999

*Attest:*

Q. TODD DICKINSON

*Attesting Officer*

*Acting Commissioner of Patents and Trademarks*